US006485177B2

(12) United States Patent
Bell

(10) Patent No.: US 6,485,177 B2
(45) Date of Patent: Nov. 26, 2002

(54) FLEXIBLE STAND-UP POUCH CONSTRUCTIONS FOR DISPENSING LIQUIDS

(76) Inventor: Gary M. Bell, 6109 Medicine Lake Rd., Crystal, MN (US) 55422

( * ) Notice: Subject to any disclaimer, the term of this patent is extended or adjusted under 35 U.S.C. 154(b) by 0 days.

(21) Appl. No.: 09/800,692

(22) Filed: Mar. 7, 2001

(65) Prior Publication Data

US 2002/0126921 A1 Sep. 12, 2002

(51) Int. Cl.[7] ..... B65D 33/00

(52) U.S. Cl. ..... 383/210; 383/93; 383/104; 383/202

(58) Field of Search ..... 383/210, 211, 383/104, 35, 202, 93

(56) References Cited

U.S. PATENT DOCUMENTS

| | | | | | |
|---|---|---|---|---|---|
| 3,051,368 | A | * | 8/1962 | Schneider et al. | 383/210 X |
| 3,316,950 | A | * | 5/1967 | Fleischer et al. | 383/42 |
| 3,471,005 | A | * | 10/1969 | Sexstone | 383/210 X |
| 3,791,570 | A | * | 2/1974 | Hopkins | 383/210 |
| 3,799,914 | A | | 3/1974 | Schmit et al. | |
| 4,484,904 | A | * | 11/1984 | Fowler | 383/35 X |
| 4,759,472 | A | * | 7/1988 | Strenger | 383/210 X |
| 4,762,514 | A | | 8/1988 | Yoshida | |
| 4,786,190 | A | * | 11/1988 | Van Erden et al. | 383/61 |
| 4,806,021 | A | | 2/1989 | Koudstaal et al. | |
| 4,810,844 | A | * | 3/1989 | Anderson | 383/210 X |
| 4,925,316 | A | * | 5/1990 | Van erden et al. | 383/61 |
| 5,330,269 | A | * | 7/1994 | Kamada et al. | 383/210 |
| 5,392,589 | A | * | 2/1995 | Buchman | 383/211 X |
| 5,425,583 | A | | 6/1995 | Wild | |
| D362,618 | S | | 9/1995 | Paling et al. | |
| 5,716,473 | A | * | 2/1998 | Gordon et al. | 383/104 X |
| 5,873,656 | A | | 2/1999 | Arkins et al. | |
| 5,941,643 | A | * | 8/1999 | Linkiewicz | 383/210 |
| 5,997,177 | A | | 12/1999 | Kaufman | |
| 6,023,914 | A | | 2/2000 | Richison et al. | |
| 6,047,817 | A | * | 4/2000 | Taylor et al. | 383/210 X |
| 6,176,615 | B1 | * | 1/2001 | Leimkuehler | 383/211 |
| 6,213,645 | B1 | * | 4/2001 | Beer | 383/61 X |
| 6,224,528 | B1 | | 5/2001 | Bell | |
| 6,270,255 | B1 | * | 8/2001 | Kaufman et al. | 383/210 X |

FOREIGN PATENT DOCUMENTS

| | | | | |
|---|---|---|---|---|
| DE | 2647399 | * | 5/1977 | 383/907 |
| FR | 1128387 | * | 1/1957 | 383/44 |
| GB | 0980859 | * | 1/1965 | 383/94 |
| WO | WO 95/23742 | | 9/1995 | |

* cited by examiner

*Primary Examiner*—Jes F. Pascua
(74) *Attorney, Agent, or Firm*—Merchant & Gould, P.C.

(57) ABSTRACT

A pouch construction has a flexible stand-up pouch having first and second opposite panels and a bottom or base gusset. The flexible pouch has a seal perimeter surrounding an open interior. In a portion of the seal perimeter, there is provided a peel seal region. The flexible pouch construction has an unsealed region, along a perimeter edge, spaced from the interior of the pouch by the peel seal region. As a result, in the unsealed region, the pouch panels can be spread apart allowing a straw or similar member to be pushed between the panels, in the region of the peel seal, to open the pouch for access to a drink contained inside. Methods of constructing such arrangements, and preferred pouch blanks that can be filled to form such arrangements are described.

17 Claims, 7 Drawing Sheets

FLEXIBLE STAND-UP POUCH CONSTRUCTIONS FOR DISPENSING LIQUIDS

FIELD OF THE INVENTION

The present invention relates to flexible pouch constructions. The invention particularly concerns bottom gusseted pouch constructions arranged to: receive and contain fluids; and, to stand up when filled with fluids. Specifically of concern is providing preferred methods and features to facilitate dispensing of drinking fluids from pouch constructions.

BACKGROUND

Stand-up flexible pouch constructions containing drinking fluids, i.e. juices etc., have become popular consumer items, and a variety of such constructions are known. One type is a pouch construction sold under the trade designation Capri Sun and containing fruit drink. The Capri Sun products, and similar constructions, generally are pouches that comprise flexible front and back panels, sometimes with a flexible bottom or base gusset. In one of the panels, there is typically provided an aperture covered by frangible membrane. In use, one punches a sharpened straw through the aperture and into the pouch. The liquid is then dispensed through the straw to the drinker.

Pouch constructions which are used in this way are described for example in U.S. Pat. No. 5,873,656; 5,997,177 and 5,425,583, the complete disclosures of which are incorporated herein by reference.

A second type of pouch construction for dispensing fluids such as drinks is described in U.S. utility patent application Ser. No. 09/661,643, filed Sep. 13, 2000 assigned to the Assignee of the present application, Kapak Corporation of Minneapolis, Minn. In this type of arrangement, a protuberance or tab is provided on the pouch, which can be torn off to allow access to the contained liquids. When used with a contained drink, typically one either tears off the tab to open a hole between the panels and drinks directly from the package; or, after the tab is torn off, inserts a drinking straw through the open hole. In U.S. design application Design Pat. No. 29/136,872 filed Feb. 8, 2001, also owned by Kapak Corporation, an arrangement using the principles of U.S. Ser. No. 09/661,643 is depicted. The complete disclosures of U.S. Ser. No. 09/661,643 and 29/136,872 are incorporated herein by reference.

SUMMARY OF THE INVENTION

A flexible pouch construction is provided. The flexible pouch construction includes first and second opposed panel sections and a bottom or base gusset, secured together to form a stand-up flexible pouch which can be used to contain liquid. The pouch generally has an outer perimeter edge, defined by the two panel sections and the base gusset. In general, a seal arrangement or region is provided along an outer perimeter portion, to secure the two panel pieces and the base gusset together defining a pouch construction open interior surrounded by seal. Preferably, in an upper region of the pouch construction, adjacent an outer or perimeter edge portion between the first and second opposed panel sections, an unsealed perimeter edge region or space is defined. A peel seal region is provided between the unsealed perimeter edge region and the interior volume of the pouch construction. The peel seal region can be forced open, under hand pressure, to obtain access to the interior of the pouch. Preferably, the peel seal is such that it can be opened by forcing a drinking straw between the two panel sections, in the region of the peel seal.

In preferred constructions, the seal material along the outer perimeter region, is configured to define the unsealed perimeter space in the form of a V construction, in some instances specifically a truncated V construction, with an apex region directed toward the pouch construction interior. Such an arrangement is convenient for insertion of a straw. In preferred arrangements, the unsealed V-shaped region projects inwardly from either a top edge of the pouch construction, or from an upper comer.

In selected embodiments, one of the panels, in the area of the unsealed perimeter space, includes an access notch therein, to facilitate manually spreading the panel sections apart in this region, and thus to facilitate opening of the pouch construction.

A preferred method of constructing such an arrangement in a form of a pouch containing liquid, is provided. In addition, preferred methods of using such a construction are provided.

BRIEF DESCRIPTION OF THE DRAWINGS

FIG. 9 generally being a view of the preferred embodiment analogous to the view shown in FIGS. 2 and 7 for the first and second embodiments respectively.

DETAILED DESCRIPTION

Figure 1:
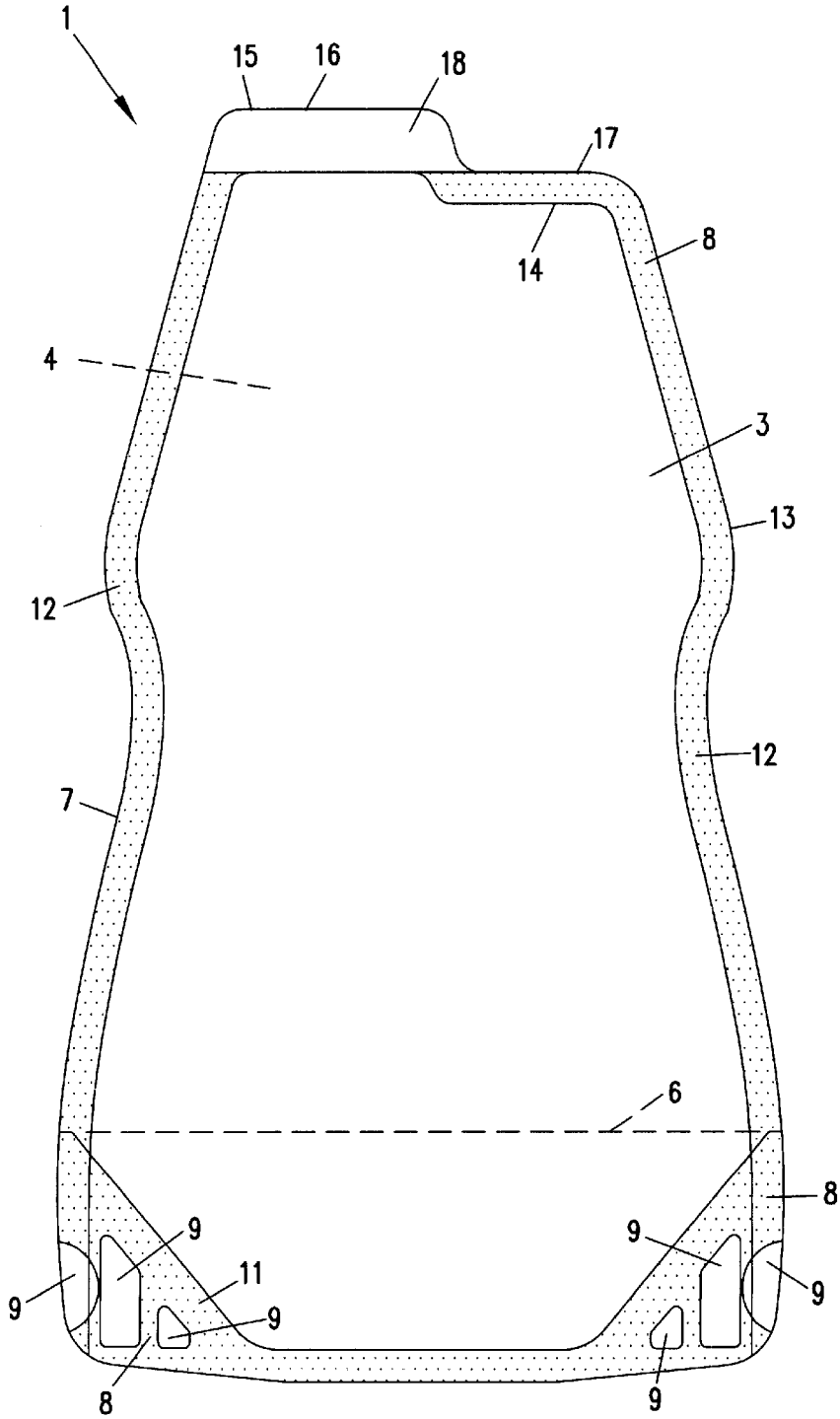
FIG. 1 is a schematic plan view of a pouch blank which, according to the principles described herein, can be filled with liquid and be provided with a preferred seal definition in a first embodiment according to the present invention.

I. Further Regarding Existing Flexible Pouch Drink Containers

A. Drink containers in Which a Straw is Poked Through a Sidewall of the Pouch

Selected issues with respect to products in which a straw is poked through an aperture covered by a membrane of, or on, a sidewall of a pouch, concern the following:

1. A straw of the type typically used for this purpose, can be inadvertently thrust completely through an opposite wall due to: the force required to punch the membrane through the aperture in the first panel; the fact that the straw is typically directed at an angle toward the opposite wall panel as it is punched through the first panel; the fact that often a sharpened straw is used; and, the fact that users (especially children) may not be adept at managing both the punching force and the punching direction to prevent such accidents from occurring.
2. If the flexible pouch construction is squeezed during the punching effort, liquid can be squirted (leaked) back out through the aperture either by passage through the straw or through the opened aperture and around the straw.

Also, such pouch constructions or arrangements can be inconvenient once the straw is punched through a sidewall of the pouch construction. For example, the straw projects outwardly from one of the side panels as opposed to the top of the pouch construction. This means that the squeeze pressure applied by a hand holding the pouch construction, is more likely to squeeze liquid up as high as the aperture, especially if the pouch construction is tipped, since the aperture is not located at or near the top of the pouch construction. Also, the pouch construction is less convenient to handle because the straw projects from a side as opposed to the top.

A problem with the use of a membrane over an aperture to provide for a region to punch, is the provision of a membrane and seal which are both adequately impervious to passage of air and/or moisture to provide for a good seal. Also, a manufacturing step of applying and sealing the membrane is required.

Such drawbacks as those characterized in this section with respect to prior pouch constructions are typically a direct result of the utilization of configurations in which a punching operation through an aperture in a side panel is required.

B. Pouch Arrangements in Which a Tab or Top is Torn Off, to Open the Pouch.

Many of the shortcomings characterized above with respect to the punch through type arrangements, are addressed by an arrangement in which a tab is torn from the top of the package, as described in U.S. utility patent application Ser. No. 09/661,643, discussed briefly above. However, if the arrangement is one such that the tab is completely torn off, the user is faced with an issue of throwing away the tab, immediately upon opening of the package, as opposed to when the entire package is discarded. As with removable pop tabs on cans, or non-replaceable bottle caps, users may be inclined to throw these away as they begin to drink, without proper refuse disposal.

In addition, the tearing operation required can be difficult for children and others who have less fine control of their motor skills; or, who have been involved in activities making them less careful at controlling the amount of force used when the drink is opened, for example, when they have been involved in active play or sports activities.

Also, the arrangement of U.S. application Ser. No. 09/661,643, requires that a tab be provided, on the construction, in a portion that can be readily torn off. This provides some limit to the configurations of, and materials useable in, pouches with which such an approach can be applied.

II. Improved Drinking Pouch Constructions

In FIGS. 1–11, improved drinking pouch constructions according to the present invention are depicted. As will be understood from the following detailed characterizations, a number of alternate embodiments are shown, and many others are possible. In general, a common feature for the various embodiments is the provision of a region of peel seal in an upper portion of the pouch, in many instances along or adjacent an upper most surface, through which a straw is inserted between panel sections instead of through one of the panel sections, to open the pouch construction and to obtain access to the interior contents. In this context, the term "peel seal" is meant to refer to a seal which is established via heat and/or pressure in a selected region of the pouch and which is also of a strength and type such that it can be readily peeled apart or forced apart through hand manipulation, typically either by the fingers grasping opposite sides of the pouch in the region adjacent the peel seal and peeling the pouch panels apart at the seal; or, preferably, by forcing a straw or similar construction between the pouch panel sections secured together by the peel seal, thus forcing the peel seal to peel open. Of course, the peel seal also should be of adequate strength to remain closed and to contain liquid without leakage, during normal storage and handling of the pouch construction prior to intended opening.

In this context the term "upper portion" is meant to typically refer to a location above a normal uppermost level of contained liquid.

In general, it is foreseen that a pouch construction would typically be prepared by a pouch manufacturer and be provided in a form having an open filling section. The pouch construction would then be provided to a drink packager, who would fill the pouch with drinking fluid and seal the pouch along the filling portion, with an appropriate peel seal. Typically, a straw would be packaged with the pouch construction, and the packaged drink would be distributed for use. When so packaged, the end user would take the straw, and insert it as directed through a peel seal portion of the pouch construction, and between the panels, to obtain convenient access to the contained drink.

Typically, the pouch construction will be provided by the pouch manufacturer to the drink packager as a blank which is "peel seal ready". By this it is meant that the arrangement is provided in a form such that by application of heat and pressure, an unsealed peel seal region can then be sealed. That is, the drink packager would not apply the peel seal, but merely would utilize equipment to seal a peel seal ready portion of the arrangement closed. The peel seal ready portion arrangement would be, typically, regions left open, for filling with liquid during the packaging operation. However, it is foreseen that alternatives may be practiced. For example, in some arrangements the pouch manufacturer may provide for the peel seal in a closed state, while leaving a portion of the arrangement open to be sealed by the package manufacturer with a permanent seal.

A. The Embodiment of FIGS. 1–5

Figure 2:
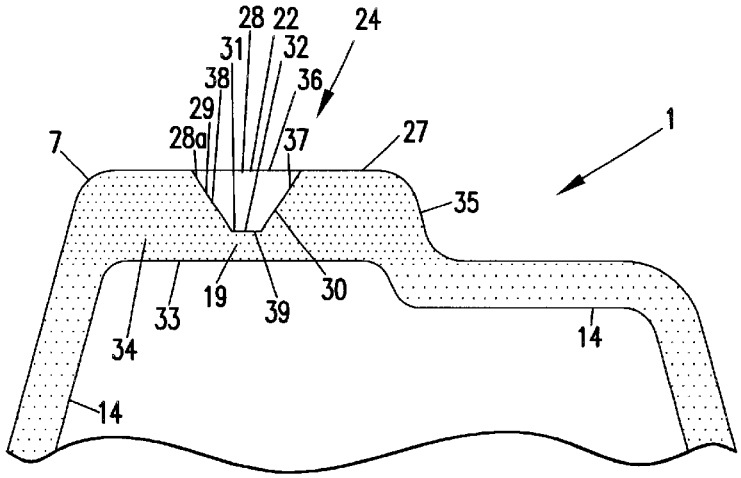
FIG. 2 is a schematic, fragmentary plan view of a portion of the arrangement shown in FIG. 1, depicted after being sealed to define a preferred sealed region and unsealed region in accord with a first embodiment of the present invention.
Figure 3:
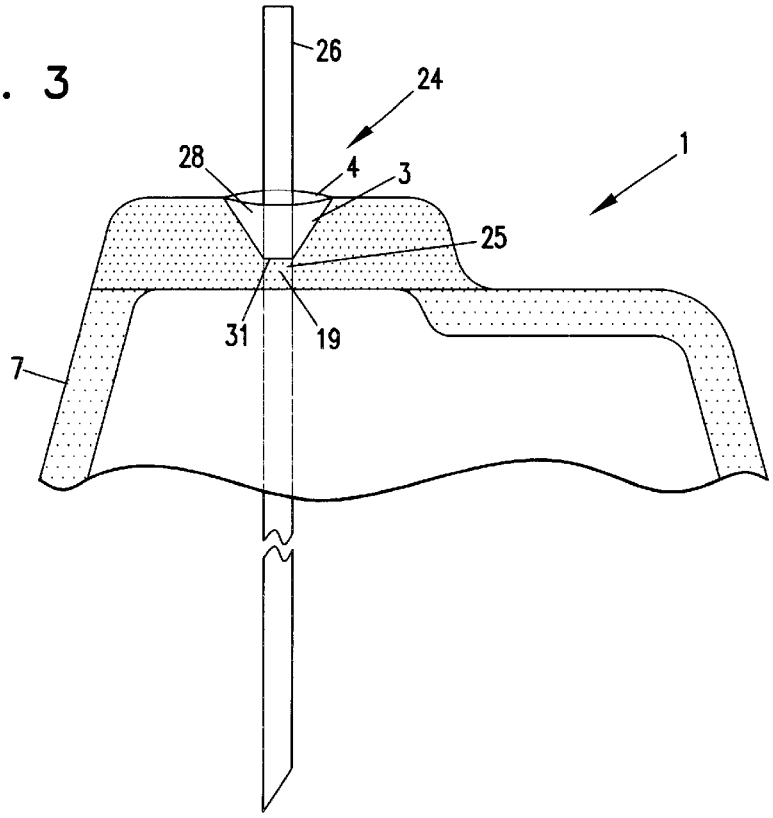
FIG. 3 is a schematic, fragmentary plan view analogous to FIG. 2, but depicted after a step of inserting a drinking straw through a portion of the arrangement, for access to contained liquid.
Figure 4:
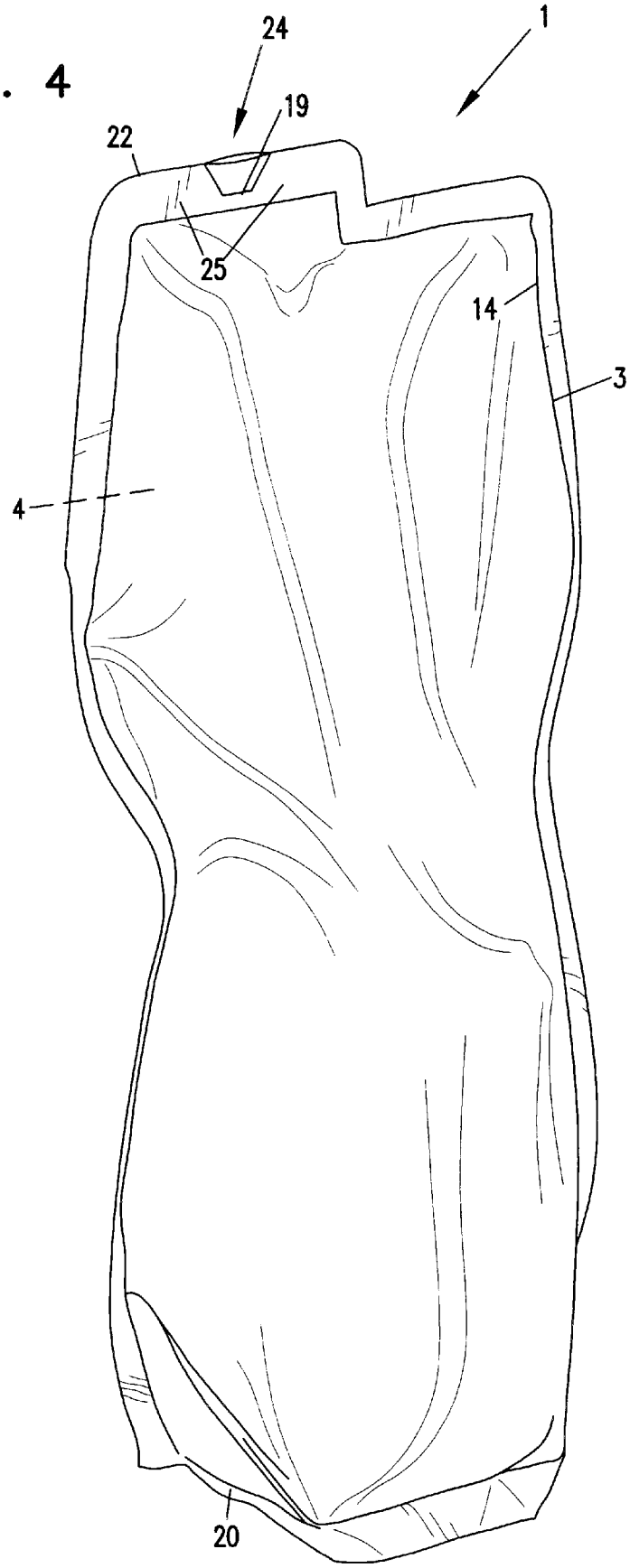
FIG. 4 is a perspective view of the arrangement depicted in FIGS. 1–3, filled with liquid, in a standing orientation, prior to insertion of a drinking straw and showing an unsealed region flared, for clarity.
Figure 5:
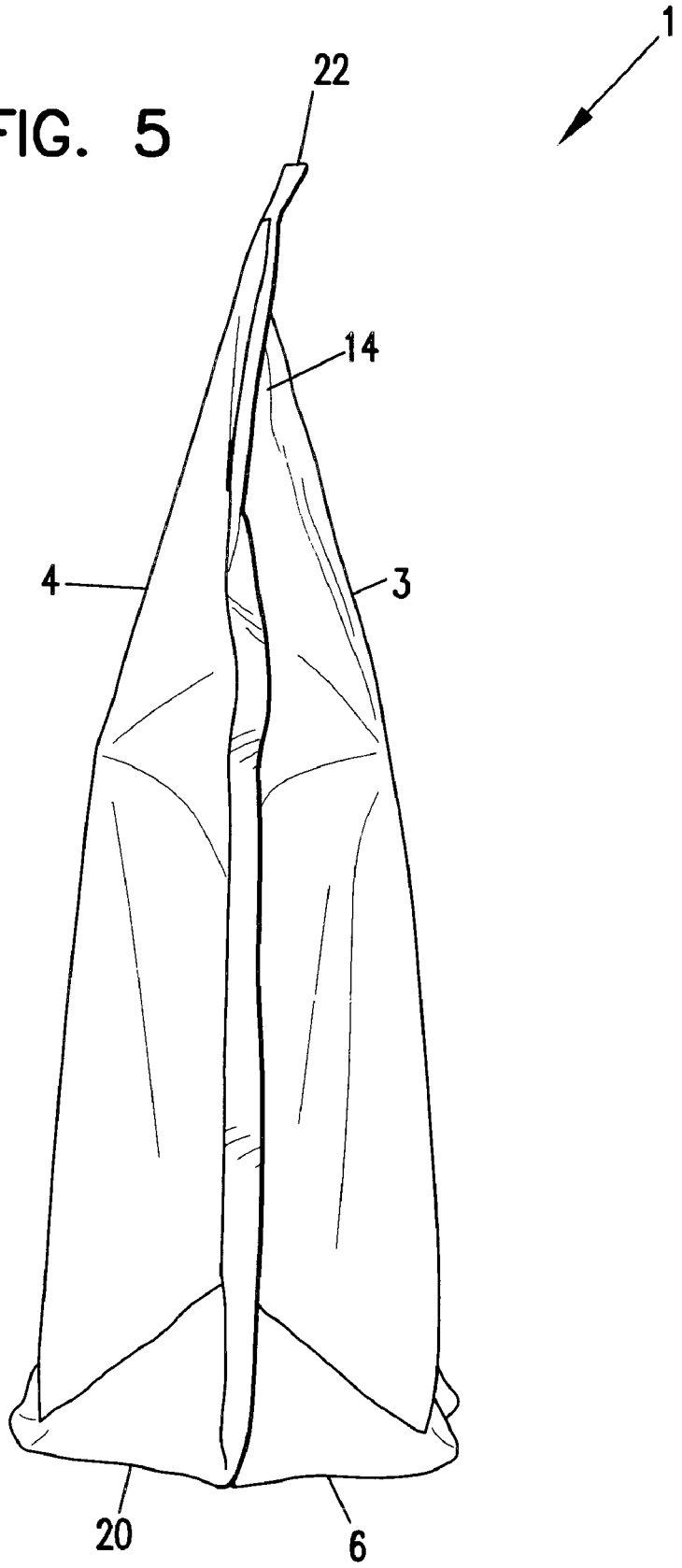
FIG. 5 is a side elevational view of the arrangement depicted in FIG. 4, but not depicting a flare in the selected unsealed region.

Attention is first directed to FIGS. 1–5. In FIG. 1, a schematic plan view of a flexible pouch construction useable according to the techniques described herein is shown, collapsed and prior to being filled with liquid. In FIG. 2, a fragmentary schematic depiction is shown of the pouch construction 1 of FIG. 1, after the pouch construction 1 has been filled with liquid and been sealed by a peel seal. In FIGS. 4 and 5, the pouch construction 1 is depicted filled with liquid and prior to being opened with a drinking straw. In FIG. 3, a fragmentary schematic depiction of the pouch construction 1 is shown, with a straw 26 inserted through a portion of peel seal, to obtain access to contained drink.

In FIG. 1, the pouch construction 1 is depicted, schematically, in the manner it would appear when provided in a collapsed form, from the pouch 10 manufacturer to the drink packager, for filling. Referring to FIG. 1, the pouch construction 1 comprises first and second, opposite or opposed, flexible panels 3 and 4, and a flexible bottom or base gusset 6. The panels 3, 4 and base gusset 6 can be generally as described in U.S. Ser. No. 09/661,643, incorporated herein by reference, except as modified to accommodate a peel seal opening arrangement as opposed to a tear tab opening. The panels 3, 4 and base gusset 6 define outer edges 7 to the construction 1.

Permanent seals in the pouch construction 1 are depicted in the stippled regions designated at 8 in FIG. 1. The permanent seals 8 are generally formed by adequate heat and pressure to permanently secure the various engaged pieces to one another. Regions 9, which are unsealed, facilitate spreading the pouch construction open when standing it up. The permanent seals in regions 11 provide for appropriate attachment of the two panels to the internally received gusset 6, so that the gusset can be expanded open when the package is filled and stood up. Permanent seals in regions 12 generally comprise perimeter edge seals or side seals at which the front and back panels 3 and 4 are secured directly to one another. Herein the term "permanent" and variants thereof is meant to refer to a seal which is not constructed to be readily opened by hand pressure, and which is intended to remain sealed during normal product use.

As will be understood from the following descriptions, in general, the panel section 3 and 4, along with the bottom gusset 6, define a package construction having an outer perimeter 13 and an open interior 14. After being filled with liquid, a perimeter seal pattern is provided to define and completely surround an open pouch interior which contains the liquid. In at least one portion of the arrangement, the perimeter seal is a peel seal, for advantages described below. Herein the perimeter seal may be referred to as "closed" when the seal completely closes off the interior 14 and as "open" when it has not yet been completely closed, or after it has been opened to allow access to contained liquid. Thus, when open, the perimeter seal allows fluid flow between the pouch construction interior 14 and the environment, but no such communication is allowed when the perimeter seal is closed.

Edge 15 of the pouch construction defines the top 16, when the construction 1 is filled and stood. For the particular pouch construction 1 depicted, edge 15 is partially sealed by the pouch manufacturer in region 17, but is left unsealed in region 18. Thus, at region 18 an opening between the first and second panels 3 and 4 is provided, to allow for filling of pouch construction 1 with liquid, by a drink packager. After the pouch arrangement 1 is filled by the drink packager, region 18 is sealed closed completing the perimeter seal around the open interior 14; and, allowing the pouch construction 1 to be stood up, stored and handled without leakage. For the particular arrangement shown, region 18 is peel seal ready. That is, it is constructed such that after the drink manufacturer fills the pouch construction appropriately with drinking fluid, when the seal is formed at region 18, it is formed as a peel seal. The term "peel seal ready" is meant to refer to the materials in the region of the eventual peel seal as being able to form a peel seal under appropriate heat and pressure, without more.

In FIGS. 4 and 5, the pouch construction 1 is depicted filled with liquid, sealed completely around its interior 14 and stood up. That is, in FIGS. 4 and 5 the perimeter seal is depicted closed. Referring to FIGS. 4 and 5, for the pouch construction 1 depicted, the front and back panels 3 and 4 are readily viewable, spread by the contained liquid in a manner such that along base region 20, the base gusset 6 is opened to support the standing orientation. As a result, the pouch construction 1 includes or defines a pouch top edge 22 along the tops of the panel sections 3, 4.

Referring specifically to FIG. 4, in region 24 a seal 25 is provided, to secure the first and second panels 3 and 4 to one another; seal 25 having been provided by the drink package manufacturer after liquid had been placed within the pouch construction 1. At least a portion of the seal 25 in region 24 is preferably a peel seal 19 of the type characterized herein. As a result, in at least a portion of the region 24, the panels 3 and 4 can be readily forced apart by a user, using hand pressure or preferably a straw, to obtain access to the contained drinking liquid.

With respect to this, attention is directed to FIGS. 2 and 3 in which region 24 the pouch construction 1 is depicted in fragmentary schematic view. In FIG. 2, region 24 is depicted prior to being opened by a straw; and in FIG. 3, region 24 is depicted with a straw 26 inserted therethrough, to open the perimeter seal for access to the drinking fluid contained within the pouch construction 1. The straw 26 depicted has a sharpened end 41 to facilitate opening.

Referring to FIG. 2, in which seal region 24 is depicted, by stippled region 27, preferably peel seal 19 is used at least where the straw 26 is to be inserted.

In region 28, however, there is provided an unsealed perimeter edge region or portion between panel sections 3, 4 at which the first and second panel sections 3, 4 are not secured to one another. For the particular pouch construction 1 depicted, the unsealed perimeter edge region 28 is positioned with one side thereof defined along the pouch upper or top edge 22.

From a review of FIGS. 1 and 2, then, it will be understood that, in general, for the preferred embodiment shown, the perimeter seal of the construction 1, when completely closed or sealed after the drink packager has used the construction 1, completely surrounds or circumscribes the interior portion 14 of the pouch construction 1, and at all locations also preferably borders the actual outside edges 7, except in the region of the unsealed perimeter edge portion 28. In the region of unsealed perimeter edge portion 28, the preferred perimeter seal extends at a location positioned between unsealed perimeter edge region 28 and the pouch construction open interior 14, and thus is spaced from region 28*a* of edge 7. The particular unsealed perimeter edge portion or region 28 depicted comprises an unsealed access region between the opposite panels 3, 4 bordered by edge region 28*a* on one side and by seal on three sides: i.e. first and second opposite lateral seal borders 29 and 30 and base seal border 31. Herein the term "base seal border", "base border" and variants thereof when used in this context, is meant to refer to a region of peel seal through which a straw is directly forced, when opening the package 1. The base border 31 is generally located on the shortest line extending directly between a package innermost portion 32 of the unsealed region 28, and the open interior 14 of pouch construction 1. The base border 31 is generally of limited width, in the direct direction from region 28 into the interior 33, most preferably not more than 6 mm, and typically 1.5 to 4.5 mm. The material in regions 29 and 30 may comprise a permanent seal, provided an adequate peel seal is provided at or near base border 31 to provide convenient opening. Of course, the peel seal may extend along regions 34 at locations in addition to the base portion or base border 31. The dimensions given for preferred base borders for the embodiments described herein, are meant to refer to a region adequate to accommodate a typical drinking straw, under hand pressure, as would be utilized to open the preferred pouch construction.

A variety of configurations can be utilized for unsealed perimeter edge region 28. In general, preferred configurations have a generally V-shape, with the apex of the V directed toward the pouch interior 33. The particular region 28 depicted has a type of V configuration referred to herein as a "truncated V". By the term "truncated V" in this context, it is meant that the region 24 has, projecting from edge 36, first and second sides 37 and 38 directed in a V pattern to a flat or a truncated apex indicated at 39. When a truncated V is used, preferably the truncated apex 39 has a width between sides 37 and 38 of no greater than 6 mm and typically 1.5 mm to 4.5 mm.

It is foreseen that the sides 37 and 38 for typical embodiments will be mirror images of one another oriented to extend inwardly at an angle, toward one another relative to edge region 28*a*, within the range of 25° to 70°. The particular ones depicted extend at an angle of about 50°–60°.

Again, it is noted that a variety of alternate configurations may be chosen, including ones that are not V-shaped, and/or in which there is no symmetry. Indeed, nonlinear sides to the region 28 can be used.

Preferably, the region 28*a* has a width, when oriented along a single edge 36, in which the first and second panels 3, 4 are not sealed to one another, preferably extending over a distance of at least 5 mm, but preferably not more than 40 mm, and typically, depending on the embodiment, within the range of 8 mm to 35 mm. For an embodiment using a top tab portion 35 such as the embodiment shown in FIGS. 1–5, typically an unsealed edge region 28*a* of 8 mm to 15 mm will be used.

Use of unsealed region 28 in combination with the peel seal base border 31, to obtain access to fluid within the pouch construction 1, is demonstrated in FIG. 3. Specifically, in FIG. 3 drinking straw 26 is shown having been inserted between the panels 3 and 4 in region 28, and then forced through base border 31, opening the peel seal 19 in this region. Typically, the drinking straw 26 used will have sharpened or truncated tip 41, to facilitate sliding the straw 26 between the panels 3, 4, forcing the peel seal base border 31 open.

For typical preferred embodiments, the unsealed region 28 defines a perimeter area of at least 20 sq. mm, and, depending on the embodiment, typically within the range of 30-200 sq. mm. The term "perimeter area" is meant to refer, in this context, to the area defined by the perimeter of the unsealed region 28, including for the particular embodiment depicted in FIG. 1, edge 28*a*, sides 29, 30 and apex edge of base border 31. When the embodiment uses a top tab portion 35, typically the perimeter area of the unsealed region will be within the range of 30-60 sq. mm.

Referring again to FIGS. 1, 4 and 5, the pouch construction 1 depicted has a unique, ornamental, outside configuration. It is foreseen that a variety of alternate outside configurations for the pouch construction 1 can be utilized in association with the principles described hereinabove, for provision of access to internally received liquids. This will in part be demonstrated by certain alternate embodiments described below.

B. The second embodiment depicted in FIGS. 6 and 7

Figure 6:
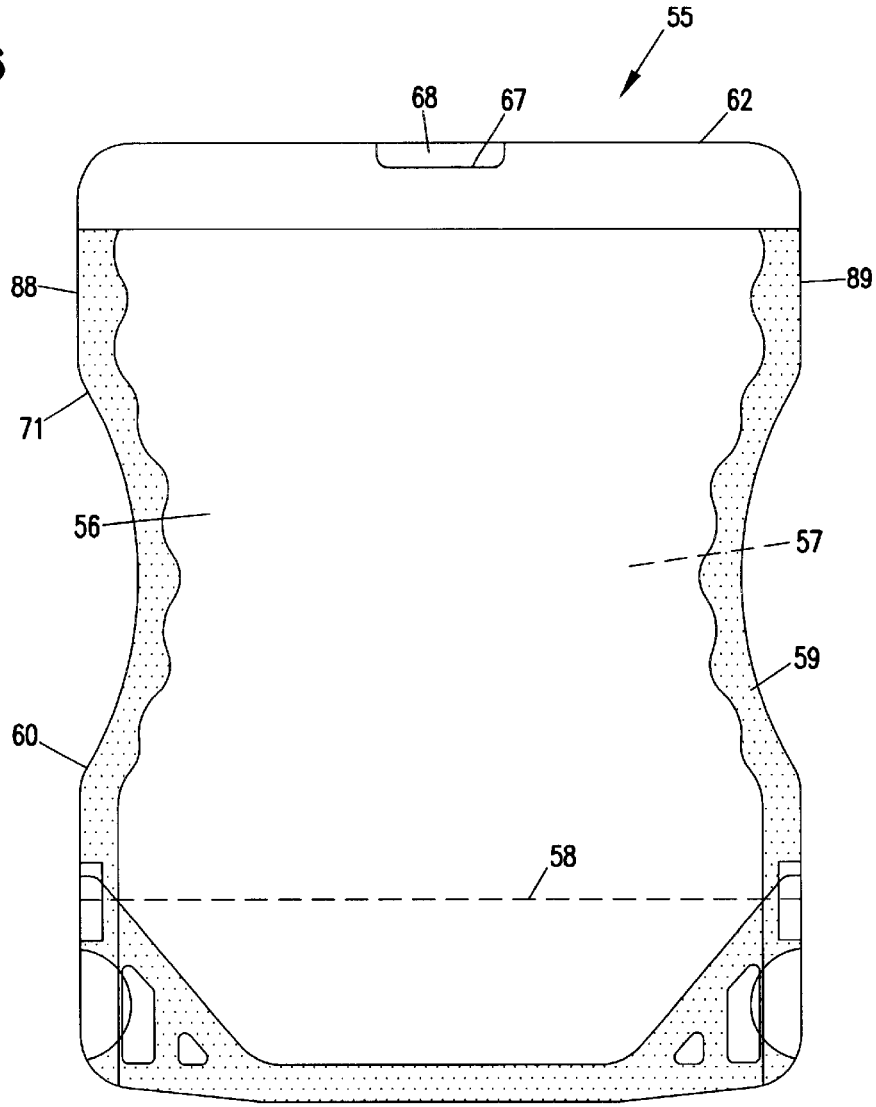
FIG. 6 is a schematic plan view of a second embodiment of a pouch construction, depicted from a viewpoint analogous to the view of FIG. 1, for the first embodiment.
Figure 7:
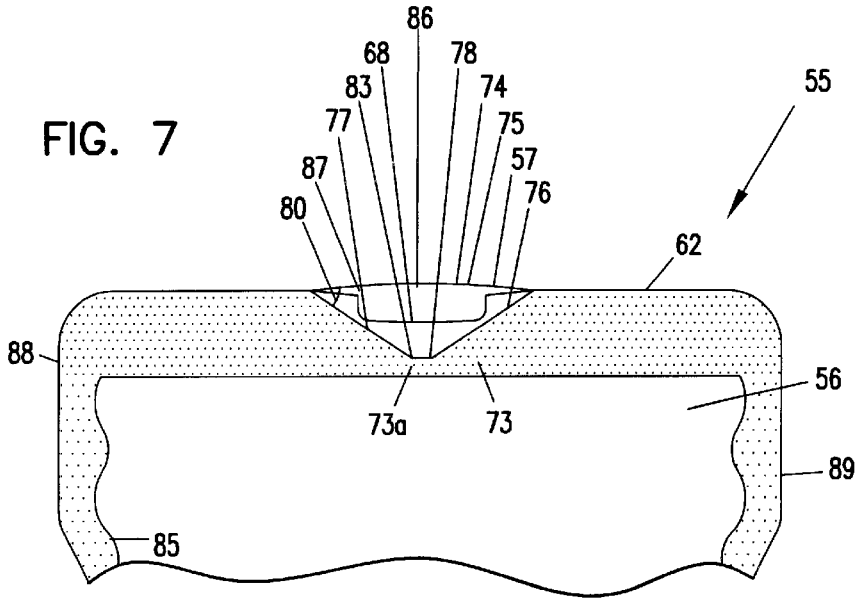
FIG. 7 is a fragmentary schematic view of the arrangement of FIG. 6, depicted after having been sealed with a sealed region and an unsealed region according to the present invention.

Attention is now directed to FIGS. 6 and 7. In FIG. 6, an alternate pouch construction 55 is depicted again as it could be made to appear prior to being filled with liquid and sealed by a drink packager. The pouch construction 55 depicted generally has first and second opposed panel sections 56, 57, bottom or base gusset 58, and permanent seal regions 59 and 60. Along top edge 62, however, the pouch construction is not sealed. Thus, along edge 62 panels 56, 57 can be spread apart, so that the ouch construction 55 can be filled with liquid. A narrower region along edge 62, for filling with liquid, can be provided, for example, by allowing permanent seals to extend into regions 64 and 65, without sealing completely across edge 62 prior to filling.

Attention is directed to cut-away portion 67 in one of the panels 56. Cut-away portion 67 provides an access notch 68 to help a user spread the panels 56, 57 apart at this location during a pouch opening operation. This will be understood better, in connection with the description of FIG. 7 below.

Still referring to FIG. 6, it is noted that the outside perimeter of 71 of pouch construction 1 differs from that shown for the arrangement of FIGS. 1–5, thus indicating that the techniques described herein can be utilized with alternate configurations of pouch constructions.

Referring to FIG. 7, a fragmentary schematic view is presented of pouch construction 55 after being filled with liquid and completely sealed, i.e. with the perimeter seal closed. At region 73, by stippling, a peel seal is shown. Along edge 62, there is provided unsealed region 74 which, among other things, surrounds access notch 68. The unsealed region 74 defined by edge portion 75, sides 76, 77, and bottom edge 78, defines a preferred, truncated V pattern. In this instance, again a symmetrical pattern is shown, this time with the angle 80 being about 35°, to accommodate notch 68 having a dimension in extension along edge 62 of about 18 mm, and a width of extension into panel 56 from edge 62, of about 4 mm. Typically, depending in part on the embodiment selecting the notch 68 will be provided with a width of extension along an adjacent edge of at least 10 mm, for example 14 mm–22 mm, and a depth of extension in from the adjacent edge of at least 2 mm, typically 2 mm–7 mm.

A typical preferred arrangement the size of notch 68 will be selected such that a perimeter area defined by the notch, i.e., by the edges of the notch 68, is within a range of 1.5 sq. mm to 12.0 sq. mm; typically 40 sq. mm–80 sq. mm and, such that when used with a notch, the perimeter area of the unsealed region 74 is within a range of about 100 sq. mm to 200 sq. mm, and is preferably at least 50% larger in area than the notch.

As preferred with the first embodiment of FIGS. 1–5, the arrangement of FIGS. 6 and 7, when sealed closed, preferably includes a peel seal base border 83 or apex having a width of preferably no more than 6 mm and typically 1.5 mm to 4.5 mm and a depth, i.e. dimension directly toward interior 85, of preferably no more than 6 mm and typically within the range of 1.5 mm to 4.5 mm. Thus, during use, pouch construction of FIG. 7 can be readily opened by inserting a straw between panel sections 56, 57 to force the peel seal 73 in the region 73*a* of base border 83 open. The notch 68, again, facilitates spreading the panels 56, 57 apart, to get the insertion of the straw started.

From a review of FIG. 7, benefit provided by the access notch 68 should be apparent. As a result of the notch 68, surface 86 of panel 57 is exposed. A user can place a finger or thumb on the region 87 to spread panels 56, 57 apart at those locations, to facilitate opening.

It is noted that for the embodiment of FIGS. 6 and 7, the unsealed perimeter region 74 is centered along edge 62 between opposite sides, 88, 89 of the pouch construction 55.

C. The Third Embodiment of FIGS. 8 and 9

Figure 8:
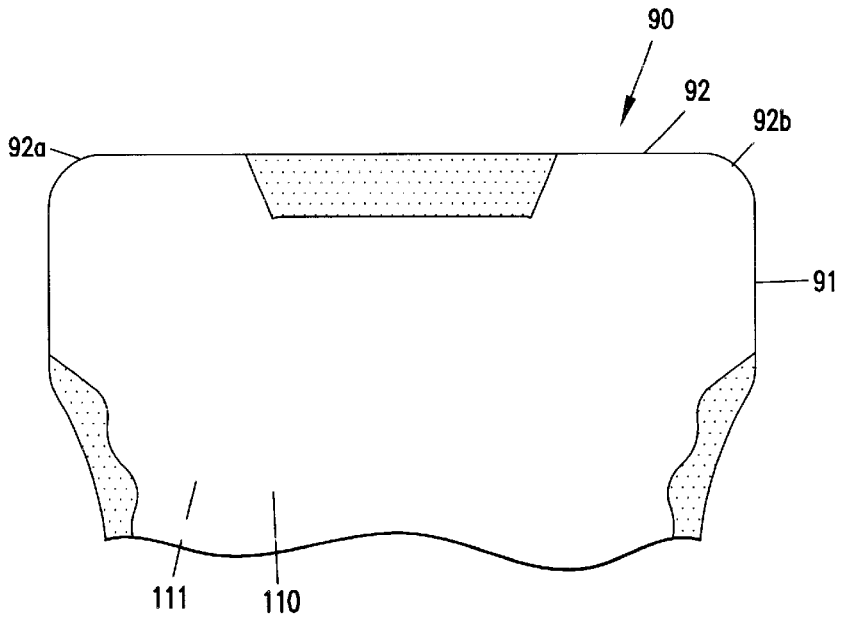
FIG. 8 is a schematic plan view of a third embodiment of an arrangement according to the invention; the third embodiment of FIG. 8 being depicted in the analogous form of that depicted in FIGS. 1 and 6 for the first and second embodiments; i.e. before sealing.
Figure 9:
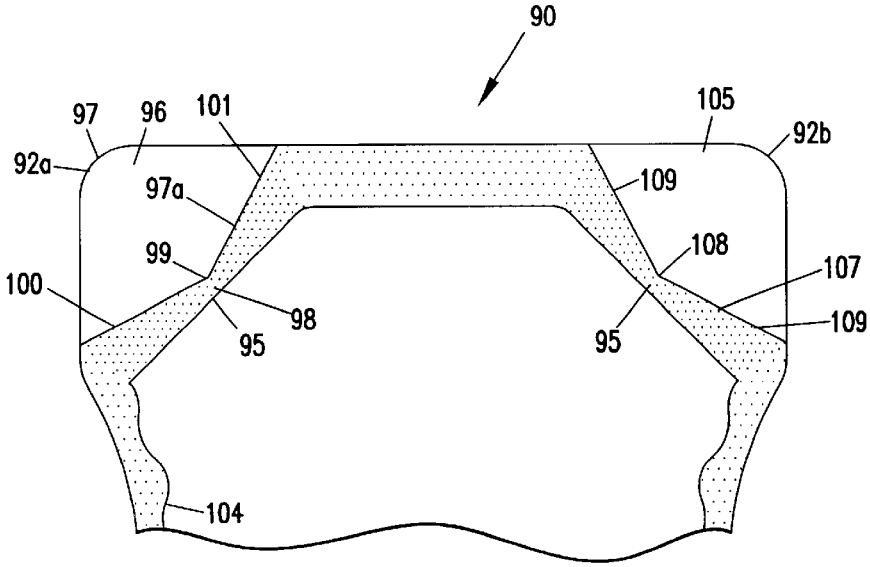
FIG. 9 is a fragmentary schematic view of the arrangement shown in FIG. 8, after filling with liquid and sealing to form a sealed region and an unsealed region according to the present invention.

Attention is now directed to FIGS. 8 and 9, in which a third embodiment is depicted. Referring to FIG. 8, it is noted that the pouch construction 90 depicted has an outer perimeter 91 of the same general configuration as the arrangement 55 depicted in FIGS. 6 and 7; the outer perimeter having an upper edge 92 having first and second comers 92*a*, 92*b* defined by opposed panel sections 110, 111. However, for the arrangement of FIGS. 8 and 9, a different peel seal arrangement is utilized, during closing by the drink manufacturer, to allow for comer entry. Referring to FIG. 9, the peel seal region is indicated at 95, with the perimeter seal closed. The peel seal region at 95 defines a comer unsealed region 96 having, coming in from the comer 97, a V-shape at edge 97*a*, and defining base peel seal portion 98, between apex 99, defined by seal sides 100, 101, and interior 104. In FIG. 9, the peel seal 95 is shown defining an optional second comer unsealed region or opening 105 at opposite comer 92*b*, again defining a V pattern 107 having apex 108 and sides 109. The arrangement 90 could be provided with either one or two corner access openings or unsealed regions 96, 105, as selected by the drink packager. Inserting a straw to the interior to the package, would be generally as described above with respect to the previous embodiments of FIGS. 1–7, i.e. the opposed, flexible, panel sections 110, 111, are spread apart at one of the unsealed regions 96, 105, and the straw is forced through the peel seal 95 in the relevant base peel seal portion 98. As with the previous embodiments, preferably the base peel seal portion 98 has a minimal thickness in direction toward interior 104, typically on the order of 1.5 mm to 4.5 mm, and preferably not more than 6 mm.

It will be apparent from review of the embodiment depicted in FIGS. 8, 9 that if desired more than one straw can be inserted, one through each corner, to allow dual access if desired. In general, when the unsealed region corner unsealed regions such as unsealed regions 96, 105, it is foreseen that the perimeter area of the region will be relatively large, by comparison to edge or edge type unsealed regions such as those for the first and second embodiments depicted above. Corner unsealed regions such as unsealed regions 96, 105, will typically have perimeter areas on the order of 150 sq. mm–600 sq. mm, the particular ones depicted being convenient for arrangements having an unsealed portion perimeter area, for each corner, on the order of 350–450 sq. mm.

The configuration results from an extension along the top edge, for the unsealed area, of about 10 to 30 mm, for the similar extension along the adjacent side edge.

D. The fourth embodiment of FIGS. 10 and 11

Figure 10:
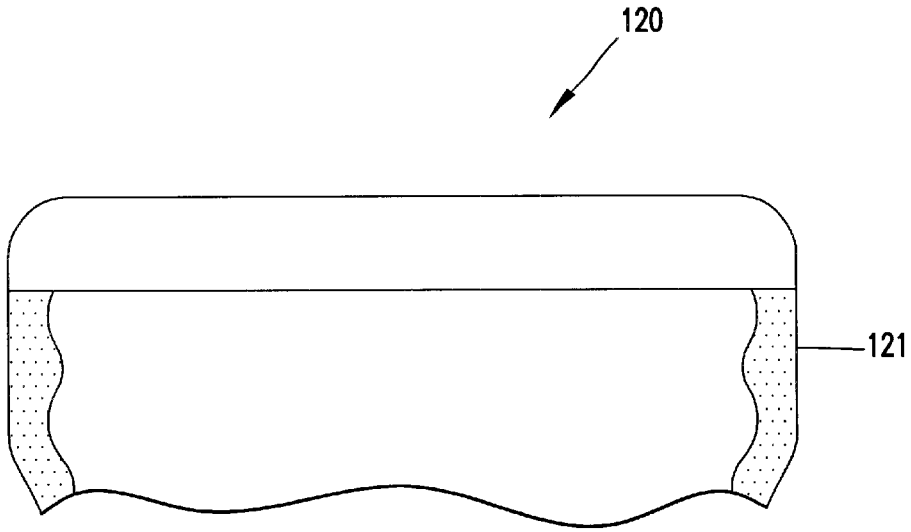
FIG. 10 is a schematic plan view of a fourth embodiment of the present invention depicted from a view point analogous to those shown in FIGS. 1, 6 and 8 for the first, second and third embodiments respectively.
Figure 11:
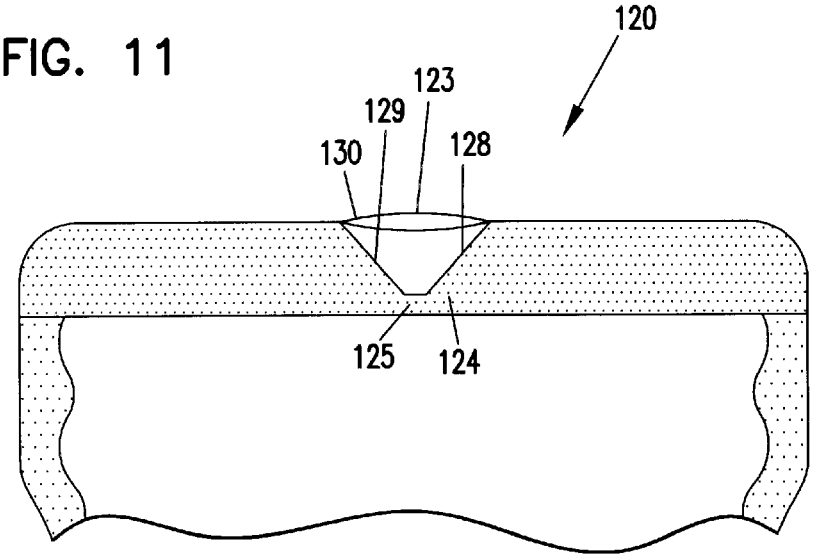
FIG. 11 is a fragmentary schematic view of the arrangement shown in FIG. 10 after having been filled with liquid and sealed to form a sealed region and an unsealed region according to the present invention; the arrangement of FIG. 11 being of the fourth embodiment from a view point analogous to that used for FIGS. 2, 7 and 9 of the first, second and third embodiments respectively.

Attention is now directed to FIGS. 10 and 11. In FIG. 10, a pouch construction 120 is depicted. The pouch construction 120 has an outside perimeter 121 similar to that to the arrangement depicted in FIG. 6. Indeed, arrangement 120 is analogous to the arrangement 55 of FIG. 6, except the arrangement 120 does not have a notch, where notch 68 is depicted in the arrangement of FIGS. 6 and 7. Referring to FIG. 11, in which the pouch construction 120 is depicted with the perimeter seal closed. The unsealed region 123, in this instance is depicted as a truncated V, surrounded by seal 124, and defining peel seal base portion 125, with sides 127 and 128 extending at a greater angle relative to edge 130, then the sides of the arrangement shown in FIGS. 6 and 7, since the width of a notch does not need to be accommodated. It is noted that in FIG. 11, the unsealed perimeter region 123 is shown flared, for clarity.

III. Formation of the Peel Seal.

Provision of peel seals between flexible members, for example the plastic panels of a flexible pouch, is known. Attention is directed for example to: U.S. Pat. Nos. 5832570; 5604000; 5538345; 5470156; 5474382; 5464969; 5425825; 4782951; 5330269; 5005707; 4966470; 4925318; and 4823961, the complete disclosures of which are incorporated herein by reference. It is foreseen that the peel seals of the general type described in these references, can be utilized in association with arrangements according to the present invention.

A variety of techniques can be utilized for the formation of the peel seal. Two general techniques useable are:

1. Utilization for the panel materials, a plastic film material having an appropriate coating thereon to allow for activation by selected heat and pressure to generate a peel seal, as opposed to a permanent seal, if desired. It is foreseen that if such material is utilized, it would be of a type for which if an alternate pressure/heat combination is selected, a permanent seal can be provided, as is desired in other portions of the construction. Useable materials, for example, include substrates of polyester, nylon, and polypropylene (available from Dupont or Unitika) laminated together using conventional lamination techniques. In some instances, a layer of aluminum foil is added in the lamination to provide for an attractive appearance. The lamination may include peel seal constructions as described above, including a polypropylene sealant comprising dissimilar materials. Examples include the peel seal constructions described in U.S. Pat. No. 4,925,318, incorporated herein by reference. Further, a resin formulated to result in a peel seal may be added.

Example resins are described in U.S. Pat. Nos. 5,470,156 and 5,474,382, each of which is incorporated herein by reference.

2. Utilization of a peel seal tape, permanently secured to the panels.

Figure 12:
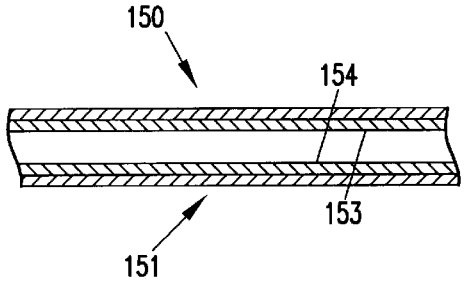
FIG. 12 is a fragmentary schematic view of a portion of one of several types of peel seal constructions useable in arrangements according to the present invention.

Attention is directed to FIG. 12 with respect to this second variation. For this variation, a two-layer peel seal tape is permanently secured to the panels. Referring to FIG. 12, opposite panels are depicted at 150 and 151, with the layers of the tape indicated at 153 and 154. Each tape layer 153, 154 has a peel seal side and a permanent seal side. Peel seal side is oriented toward the opposite peel seal tape layer, and the permanent side is permanently sealed to the panel film. The peel seal can be readily formed by applying appropriate heat and pressure to direct panel sections 150, 151 together in the region of the peel seal tape with heat and pressure applied in other portions of the arrangement where the panel sections 150 and 151 do not have peel seal tape therebetween, to form permanent seals. Peel seal tape is commercially available from such sources as Minigrip (ITW), and is readily adaptable for utilization in arrangements according to the present invention. A peel seal tape is described in U.S. Pat. No. 5,832,570, incorporated herein by reference.

IV. Manufacture and Use

Pouch constructions according to the present invention are readily manufacturable using high speed manufacturing line techniques. With such techniques, typically gusset members will be brought in line, between two elongate webs. Heat seal bars and cutters, can be used to form the particular configuration of pouch construction chosen, including for example those depicted in the figures. The heat seal bar can specifically be prevented from encountering the pouch construction and causing sealing, in the regions that are to be left open for pouch filling. Typically, the region left over for pouch filling will also be a "peel seal ready" region, to be sealed by the drink packager.

The drink packager then receives the pouch, dispenses liquid into the pouch through the unsealed portion; i.e. through an open unsealed perimeter edge portion. If the unsealed portion was also the "peel seal ready" portion, the drink packager would then form the peel seal in this region, i.e. close the region, preferably providing for the preferred configuration of unsealed region as characterized herein. That is, the closing operation would include a step of forming a peel seal extending across the previously opened unsealed perimeter edge region.

If a notch is used, it can be provided in a die cutting operation either by the pouch manufacturer or the drink packager, but typically it would be preferred that it be provided in the collapsed pouch blank provided to the drink packager, from the pouch manufacturer. In order to ensure appropriate peel seal, in general, it will be preferred to:

(a) utilize a peel seal ready material region where the peel seal is to be formed; and, (b) use an appropriately configured seal bar and an appropriate amount of heat and pressure, to allow for the generation of a peel seal as opposed to a permanent seal and the location.

Techniques to accomplish both of the above, are well known from the peel seal art and are adaptable to the present application.

It is foreseen that in typical applications, the drink packager will package the drink for retail sale, along with an appropriate straw, preferably a straw having a sharpened end. The user will then open the arrangement by inserting the straw into the unsealed perimeter edge region and through the peel seal between the two panels, to project into the interior of the pouch. The operation does not involve punching or piercing any of the panels, nor does it involve projection of the straw through any of the panels or gusset materials. Thus it is a "non-punch" operation, or a peeling operation.

The above specification, examples and data provide a complete description of the manufacture and use of the invention. Many embodiments of the invention can be made.

What is claimed is:

1. A pouch construction comprising:

(a) first and second, opposed, panel sections;

(b) a base gusset positioned between the first and second panel sections;

(i) the first and second panel sections and base gusset each comprising flexible film material and together forming a stand-up pouch having a perimeter edge, a closed perimeter seal defining and surrounding an open, interior, volume;

(c) an unsealed perimeter edge region between the first and second panel sections in a region adjacent to a perimeter edge of the pouch construction whereat the first and second panel sections can be partially spread apart;

(i) the unsealed perimeter edge region defining a perimeter area of at least 20 sq. mm;

(ii) the unsealed perimeter edge region being defined by a seal region to have a V-shaped edge with an apex region directed toward the pouch interior;

(A) the V-shaped edge having a truncated V-shaped apex with an apex edge thereof positioned spaced no more than 6 mm from the pouch interior; and (d) a peel seal region adjacent to the unsealed perimeter edge region and defining a base portion between the unsealed perimeter edge region and the pouch construction open interior volume.

2. A pouch construction according to claim 1 wherein:

(a) the first and second panel sections define a pouch top edge opposite the base gusset; and (b) the pouch top edge defines a side of the unsealed perimeter region.

3. A pouch construction according to claim 2 wherein:

(a) the unsealed perimeter edge region extends for a distance within the range of 5 mm to 40 mm, along the pouch top edge.

4. A pouch construction according to claim 2 wherein:

(a) the first panel section includes an access notch positioned in the unsealed perimeter edge region and adjacent to the pouch top edge.

5. A pouch construction according to claim 4 wherein:

(a) the notch defines a perimeter area within the range of 40 to 80 sq. mm.

6. A pouch construction according to claim 2 wherein:

(a) the unsealed perimeter edge region is centered along the pouch top edge.

7. A pouch construction according to claim 1 wherein:

(a) the first and second, opposed, panel sections define an upper pouch perimeter edge having at least a first comer; and (b) the unsealed perimeter edge region is positioned between the first and second panel sections at the first comer.

8. A pouch construction according to claim 7 wherein:

(a) the first and second panel sections define a second comer along the upper pouch perimeter edge; and (b) the pouch construction further includes a second unsealed perimeter edge region positioned between the first and second panel sections at the second comer.

9. A pouch construction comprising:

(a) first and second, opposed, panel sections;

(b) a base gusset positioned between the first and second panel sections;

(i) the first and second panel sections and base gusset each comprising flexible film material and together forming a stand-up pouch having a perimeter edge, a closed perimeter seal defining and surrounding an open, interior, volume;

(ii) the first and second panel sections defining a pouch top edge opposite the base gusset;

(c) an unsealed perimeter edge region between the first and second panel sections in a region adjacent to a perimeter edge of the pouch construction whereat the first and second panel sections can be partially spread apart;

(i) the unsealed perimeter edge region being defined by a seal region to have a V-shaped edge with an apex region directed toward the pouch interior;

(A) the V-shaped edge having a truncated V-shaped apex with an apex edge thereof positioned spaced no more than 6 mm from the pouch interior;

(ii) the pouch top edge defining a side of the unsealed perimeter edge region; and (d) a peel seal region adjacent to the unsealed perimeter edge region and defining a base portion between the unsealed perimeter edge region and the pouch construction open interior volume.

10. A pouch construction according to claim 9 wherein:

(a) the unsealed perimeter edge region extends for a distance within the range of 5 mm to 40 mm, along the pouch top edge.

11. A pouch construction according to claim 10 wherein:

(a) the first panel section includes an access notch positioned in the unsealed perimeter edge region and adjacent to the pouch top edge.

12. A pouch construction according to claim 11 wherein:

(a) the notch defines a perimeter area within the range of 40 to 80 sq. mm.

13. A pouch construction according to claim 12 wherein:

(a) the unsealed perimeter edge region is centered along the pouch top edge.

14. A pouch construction according to claim 13 wherein:

(i) the unsealed perimeter edge region defines a perimeter area of at least 20 sq. mm.

15. A pouch construction comprising:

(a) first and second, opposed, panel sections;

(b) a base gusset positioned between the first and second panel sections;

(i) the first and second panel sections and base gusset each comprising flexible film material and together forming a stand-up pouch having a perimeter edge, a closed perimeter seal defining and surrounding an open, interior, volume;

(ii) the first and second panel sections defining a pouch top edge opposite the base gusset;

(c) an unsealed perimeter edge region between the first and second panel sections in a region adjacent to a perimeter edge of the pouch construction whereat the first and second panel sections can be partially spread apart;

(i) the unsealed perimeter edge region being defined by a seal region to have a V-shaped edge with an apex region directed toward the pouch interior;

(d) an access notch defined by the first panel section and positioned in the unsealed perimeter edge region adjacent to the pouch top edge;

(i) the notch defining a perimeter area within the range of 40 to 80 sq. mm.; and (e) a peel seal region adjacent to the unsealed perimeter edge region and defining a base portion between the unsealed perimeter edge region and the pouch construction open interior volume.

16. A pouch construction according to claim 15 wherein:

(a) the unsealed perimeter edge region is centered along the pouch top edge.

17. A pouch construction according to claim 16 wherein:

(a) the V-shaped edge having a truncated V-shaped apex with an apex edge thereof positioned is spaced no more than 6 mm from the pouch interior.

* * * * *

UNITED STATES PATENT AND TRADEMARK OFFICE

CERTIFICATE OF CORRECTION

PATENT NO. : 6,485,177 B2
DATED : November 26, 2002
INVENTOR(S) : Bell

It is certified that error appears in the above-identified patent and that said Letters Patent is hereby corrected as shown below:

Column 2,
Line 14, delete “comer” and insert -- corner --.

Column 5,
Line 22, after “pouch” delete “10”.

Column 9,
Lines 25, 29, 31, 32 and 36, delete “comer” and insert -- corner --.

Column 12,
Lines 42 and 45, delete “comer” and insert -- corner --.

Signed and Sealed this

Tenth Day of June, 2003

JAMES E. ROGAN
*Director of the United States Patent and Trademark Office*